US010626779B2

(12) United States Patent
Bagnasco et al.

(10) Patent No.: US 10,626,779 B2
(45) Date of Patent: Apr. 21, 2020

(54) METHOD AND SYSTEM FOR IMPROVING DIAGNOSIS OF A CATALYST

(71) Applicant: Ford Global Technologies, LLC, Dearborn, MI (US)

(72) Inventors: Andrew Bagnasco, Plymouth, MI (US); Edward Fredericks, Wyandotte, MI (US); Mario Santillo, Canton, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 0 days.

(21) Appl. No.: 16/040,362

(22) Filed: Jul. 19, 2018

(65) Prior Publication Data

US 2020/0025056 A1 Jan. 23, 2020

(51) Int. Cl.

| | |
|---|---|
| ***F02D 41/24*** | (2006.01) |
| ***F01N 11/00*** | (2006.01) |
| ***F02D 41/14*** | (2006.01) |

(52) U.S. Cl.

CPC ..... *F01N 11/007* (2013.01); *F02D 41/1441* (2013.01); *F02D 41/1456* (2013.01); *F02D 41/2474* (2013.01); *F01N 2550/02* (2013.01); *F01N 2560/025* (2013.01); *F01N 2560/14* (2013.01); *F01N 2900/0416* (2013.01); *F01N 2900/0422* (2013.01)

(58) Field of Classification Search

CPC . F01N 11/007; F02D 41/1454; F02D 41/1456

See application file for complete search history.

(56) References Cited

U.S. PATENT DOCUMENTS

| | | | | |
|---|---|---|---|---|
| 5,357,751 | A | 10/1994 | Orzel | |
| 5,899,062 | A | 5/1999 | Jerger et al. | |
| 6,195,986 | B1 | 3/2001 | Davey et al. | |
| 6,397,583 | B1 | 6/2002 | Davey et al. | |
| 6,550,237 | B1 | 4/2003 | Adamczyk et al. | |
| 9,261,033 | B2 | 2/2016 | Sealy et al. | |
| 9,359,967 | B2 | 6/2016 | Santillo et al. | |
| 2007/0261391 | A1* | 11/2007 | Takubo | F01N 9/00 60/285 |
| 2015/0337750 | A1 | 11/2015 | Sealy et al. | |
| 2016/0061131 | A1* | 3/2016 | Santillo | F02D 41/0295 60/274 |
| 2016/0363075 | A1* | 12/2016 | Larocca | F02D 41/1456 |

* cited by examiner

*Primary Examiner* — Jonathan R Matthias

(74) *Attorney, Agent, or Firm* — Geoffrey Brumbaugh; McCoy Russell LLP

(57) ABSTRACT

Methods and systems are provided for diagnosing operation of a catalyst in the presence of oxygen sensor degradation over a vehicle life cycle. The methods and systems described herein filter the output of one oxygen sensor according to a time constant of a different oxygen sensor so that determination of a catalyst index ratio is compensated for oxygen sensor degradation.

19 Claims, 7 Drawing Sheets

INDEX RATIO VALUES
ACCORDING TO PRIOR ART
INDEX RATIO
DETERMINATION PROCESS

METHOD AND SYSTEM FOR IMPROVING DIAGNOSIS OF A CATALYST

FIELD

The present application relates to methods and systems for diagnosing operation of a catalyst that is located in an exhaust system of an internal combustion engine.

BACKGROUND/SUMMARY

A catalyst may be incorporated into an exhaust system of an internal combustion engine to convert hydrocarbons and NOx into $CO_2$, $N_2$, and $H_2O$. The catalyst may begin its life cycle with a very high efficiency level, but the catalyst's efficiency may degrade as the catalyst reaches its lifecycle limit. If the catalyst degrades sufficiently, the vehicle in which the internal combustion engine resides may not meet a legislated emissions level. One way to determine whether or not the catalyst is degraded to a level where legislated emissions levels may not be met by the internal combustion engine is to compare a ratio of line lengths generated from oxygen sensor output voltage levels. In particular, an output voltage of an upstream oxygen sensor may be converted into a length of a line and an output voltage level of a downstream oxygen sensor may be converted into a length of a line. A ratio of the lines may then be a basis for determining whether or not a catalyst is degraded. However, if the downstream oxygen sensor output is degraded such that it exhibits characteristics of a low-pass filtered oxygen sensor output, then the ratio value used to determine catalyst degradation may be influenced such that the ratio value may not be relied upon for accurately assessing the presence or absence of catalyst degradation. Therefore, it may be desirable to provide a way of compensating for downstream oxygen sensor degradation in a way that allows the ratio value to be useful for assessing the presence or absence of catalyst degradation.

The inventors herein have recognized that oxygen sensor degradation may affect determined values of a catalyst index ratio and have developed an engine operating method, comprising: filtering output of an oxygen sensor located upstream of a catalyst in an exhaust system of an engine according to a response of an oxygen sensor located downstream of the catalyst; and adjusting an actuator responsive to the filtered output of the oxygen sensor.

By filtering the output of an upstream oxygen sensor according to a time constant of a downstream oxygen sensor, it may be possible to provide the technical result of improving evaluation of the presence or absence of catalyst degradation. Specifically, in one example, a response of an oxygen sensor exhibiting little degradation may be adjusted via a digital filter according to a time constant of a second oxygen sensor that may be exhibiting more significant degradation. The digital filter may more closely align response characteristics of the less degraded oxygen sensor with the response characteristics of the more degraded oxygen sensor so that an index ratio value that describes catalyst performance may be influenced more by catalyst performance than by oxygen sensor performance.

The present description may provide several advantages. Specifically, the approach may improve catalyst degradation assessments. Further, the approach may reduce false indications of catalyst degradation that may increase vehicle warranty costs. In addition, the approach may allow catalyst degradation to be evaluated against a single constant threshold value over a course of a vehicle lifetime so that indications of catalyst degradation and expected catalyst performance may be more reliable.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

DETAILED DESCRIPTION

Figure 2:
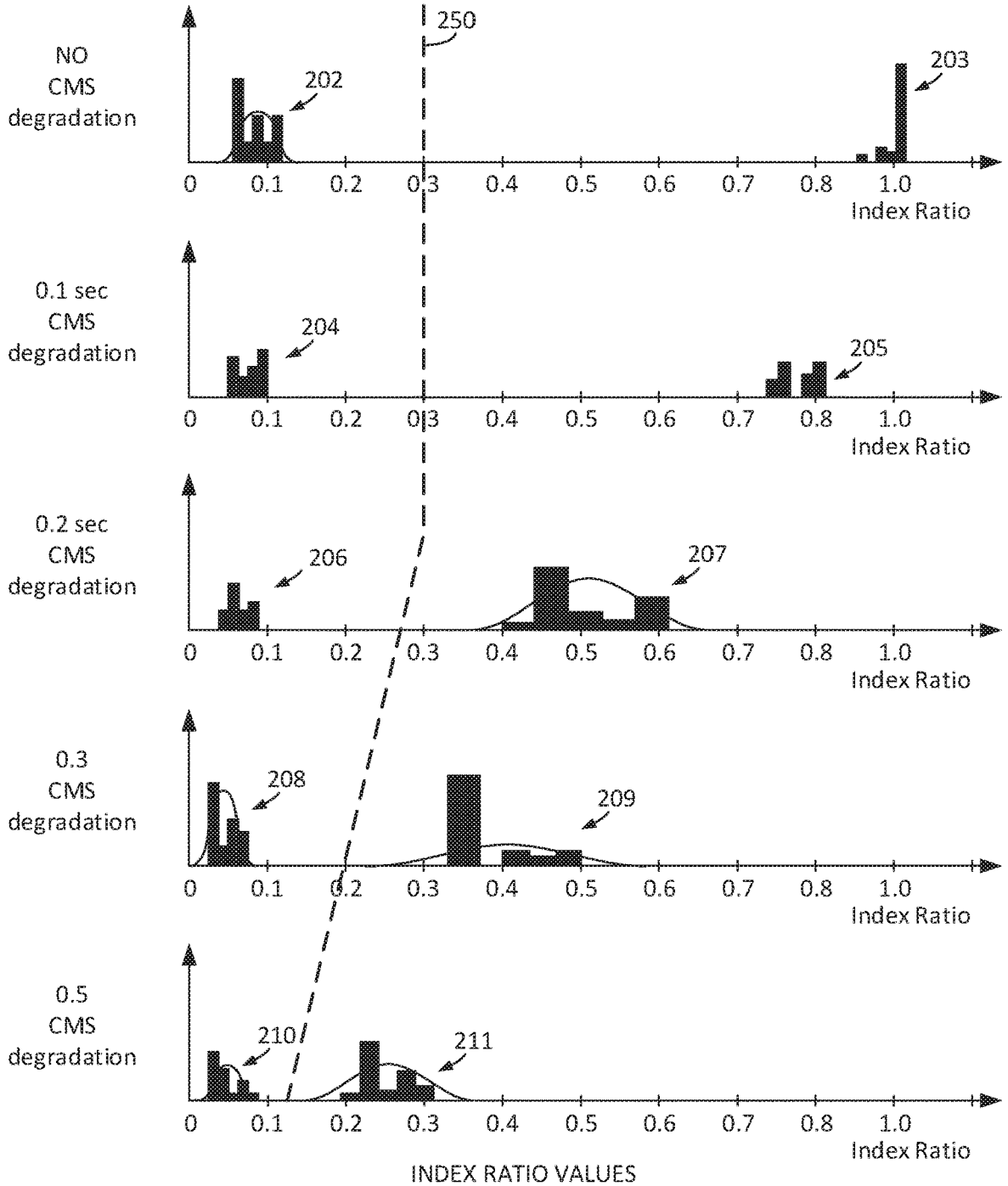
FIG. 2 shows example catalyst index ratio values for a prior art index ratio determining process.
Figure 3:
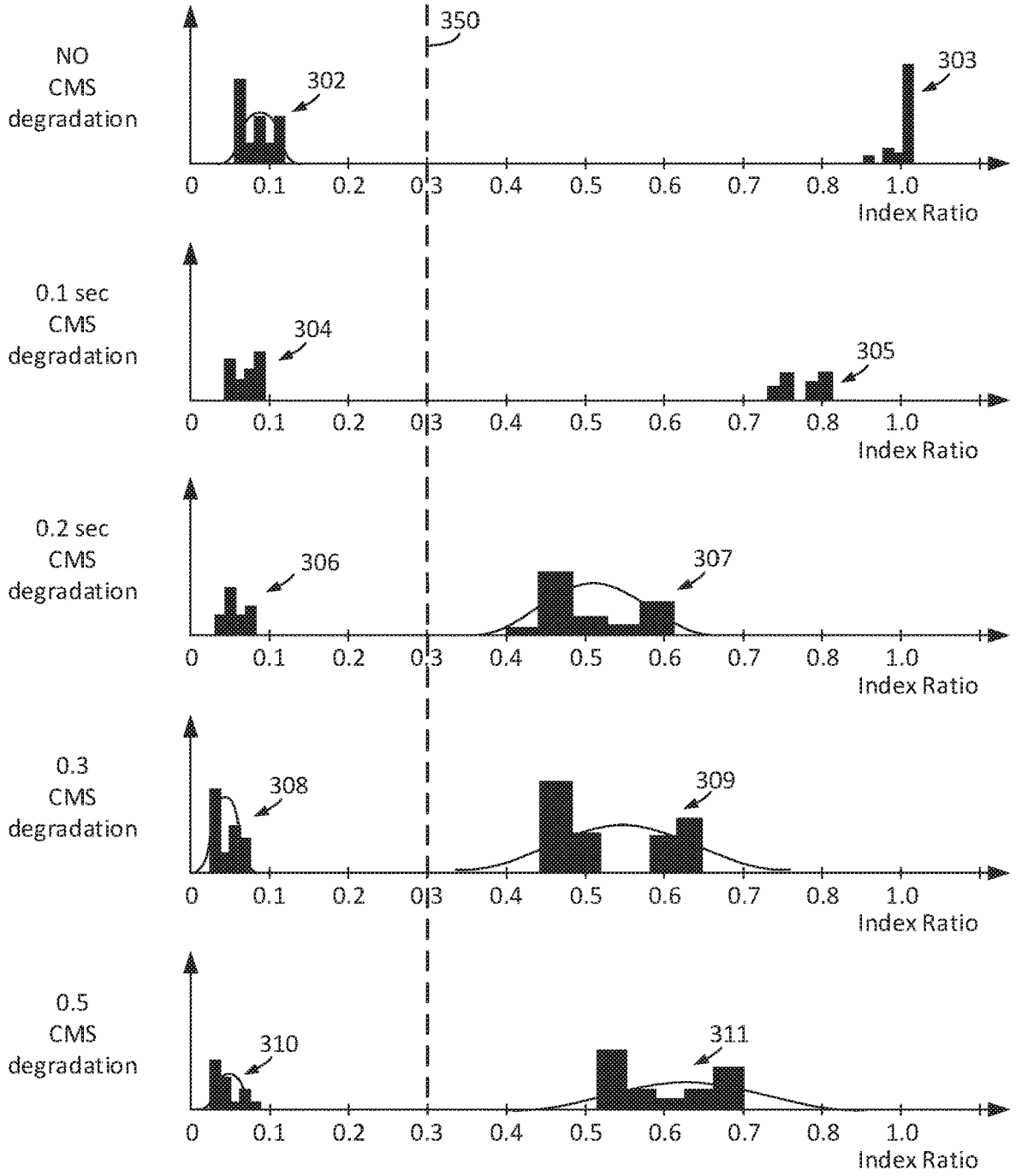
FIG. 3 shows example catalyst index ratio values for the index ratio determining process according to the present description.
Figure 4:
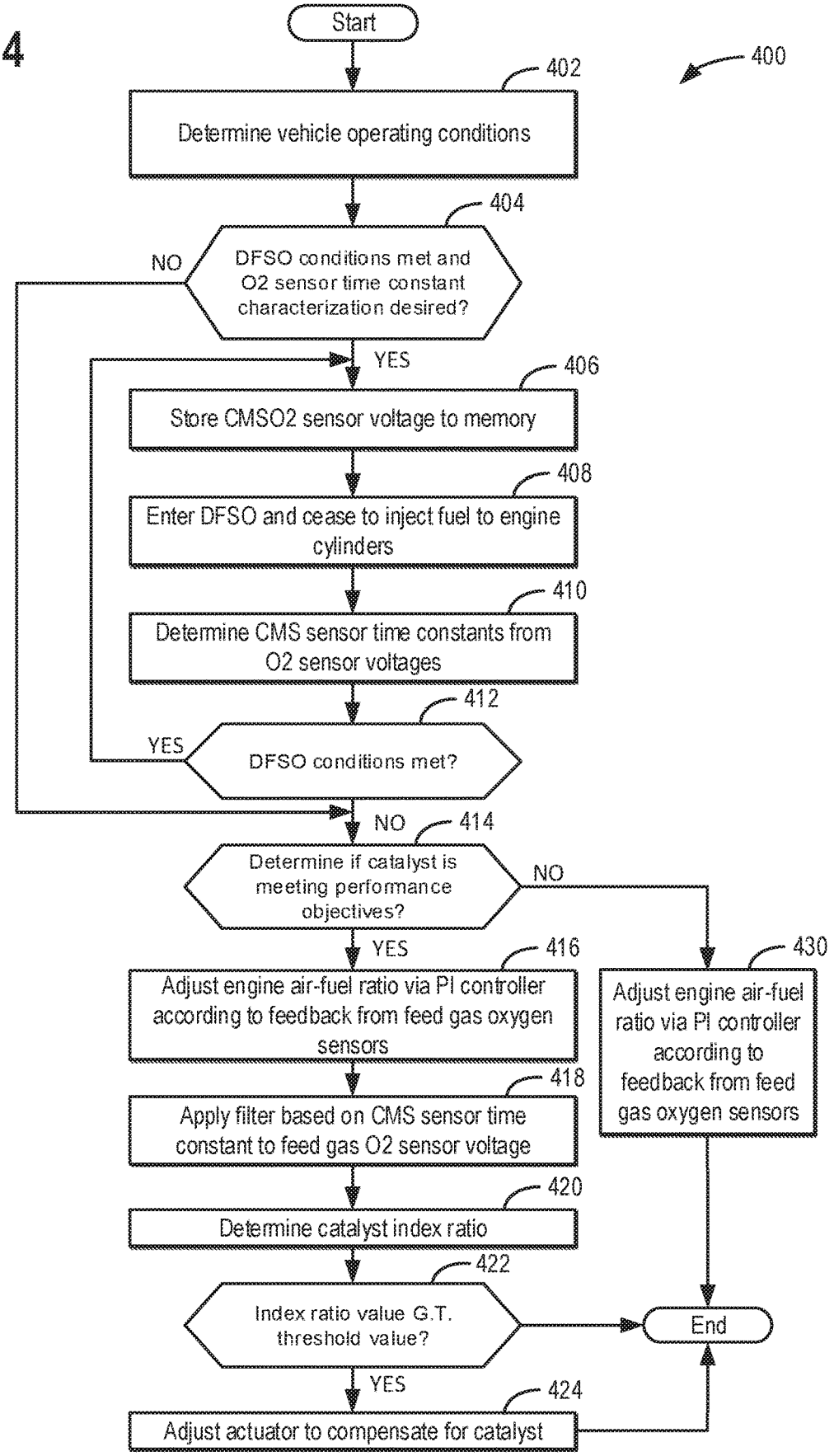
FIG. 4 shows a flowchart of a method for determining the presence or absence of catalyst degradation.
Figure 5:
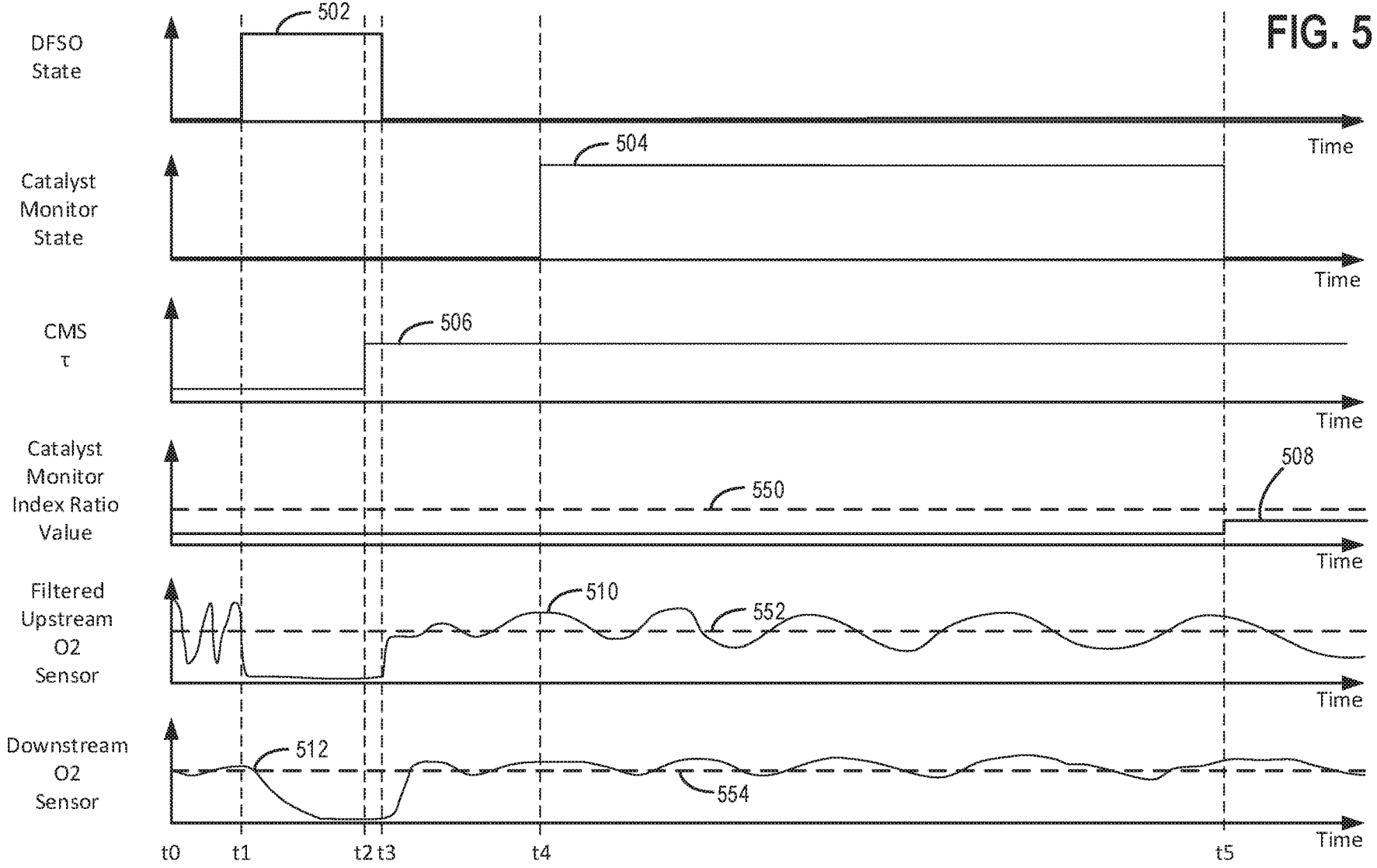
FIG. 5 shows sequence for diagnosing a catalyst according to the method of FIG. 4.
Figure 6:
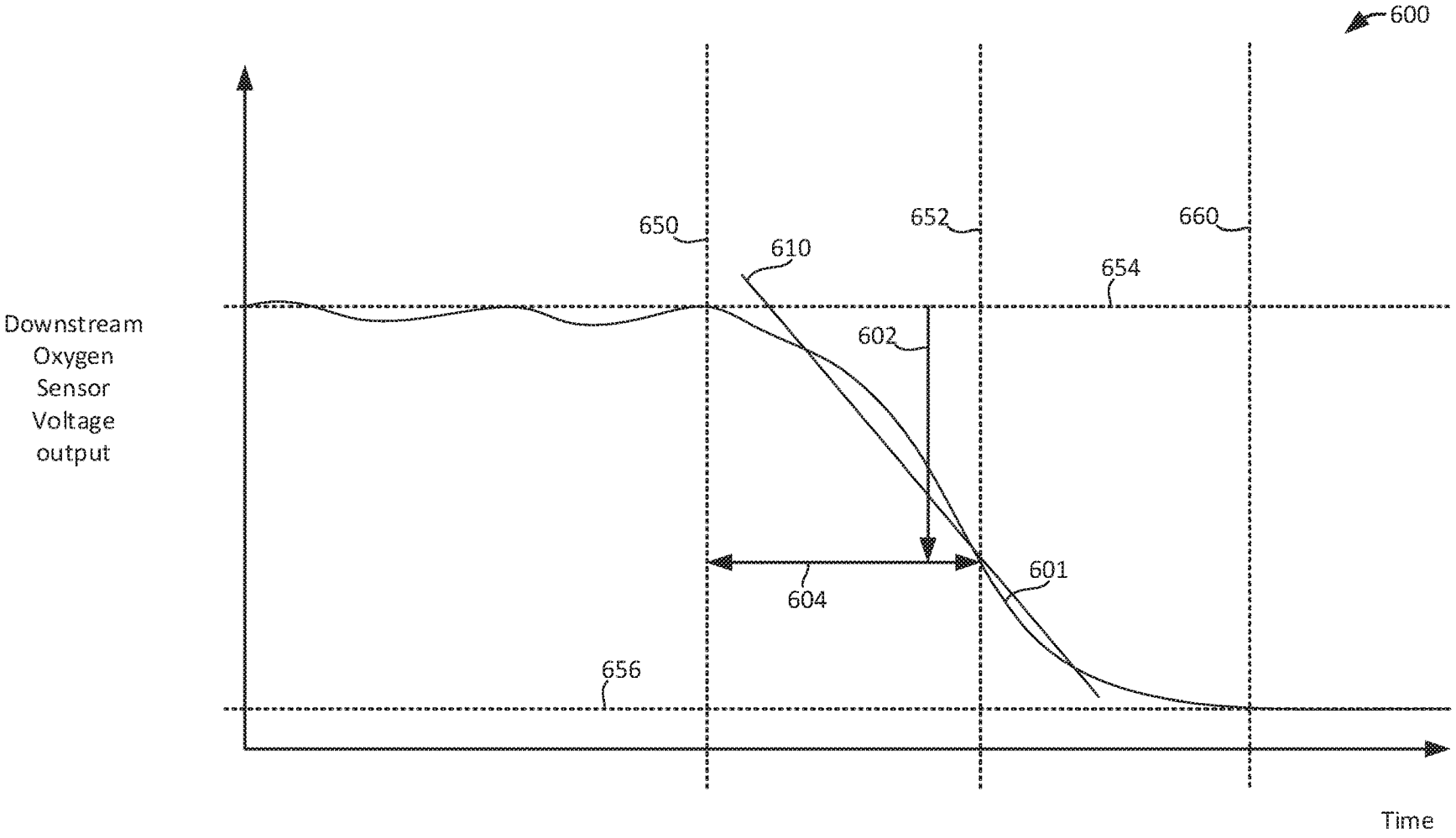
FIG. 6 shows a graphic representation of a method for determining a time constant of an oxygen sensor.
Figure 8:
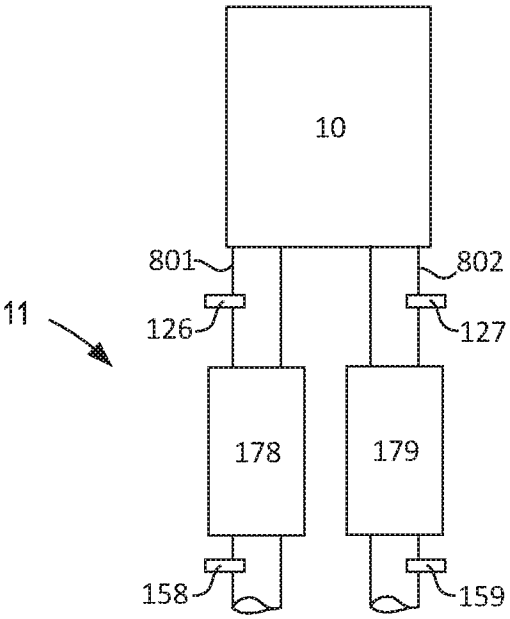
FIGS. 7 and 8 show example engine and exhaust system configurations to which the method of FIG. 4 may be applied.
Figure 7:
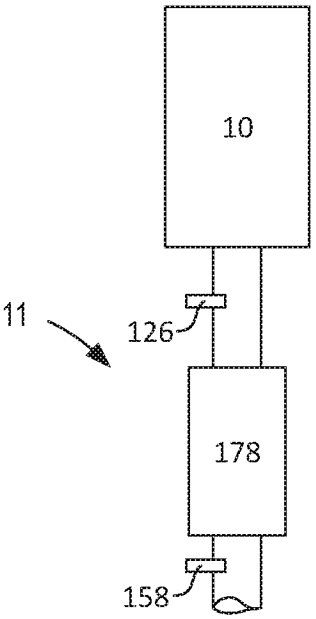

The following description relates to systems and methods for operating an engine that includes diagnostics for monitoring performance of a catalyst. The engine may be of the type shown in FIG. 1. Catalyst index ratio histograms for a prior art method for determining catalyst degradation are shown in FIG. 2. Catalyst index ratio histograms according to the present method are shown in FIG. 3. A method for determining a catalyst index ratio and applying mitigating actions is shown in FIG. 4. An example engine operating sequence according to the method of FIG. 4 is shown in FIG. 5. A method for determining a time constant of an oxygen sensor is shown in FIG. 6. Example engine and exhaust systems are shown in FIGS. 7 and 8.

Figure 1:
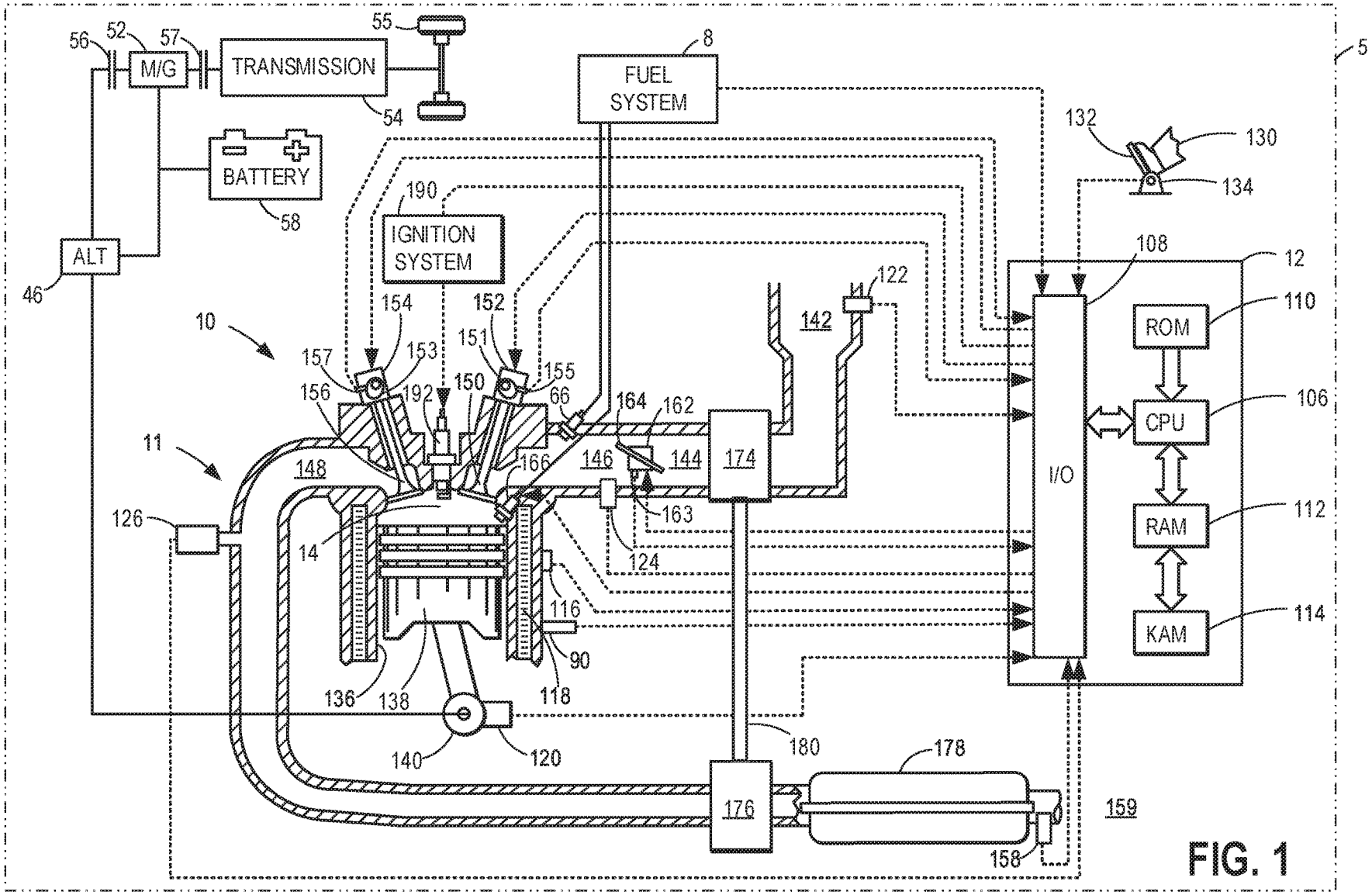
FIG. 1 shows a schematic depiction of an engine system of a vehicle.

Turning now to the figures, FIG. 1 depicts an example of a cylinder 14 of an internal combustion engine 10, which may be included in a vehicle 5. Engine 10 comprises a plurality of cylinders, one cylinder of which is shown in FIG. 1, is controlled by electronic engine controller 12. The controller 12 receives signals from the various sensors shown in FIG. 1 and employs the actuators shown in FIG. 1 to adjust engine operation based on the received signals and instructions stored in memory of controller 12.

Engine 10 may be a fueled via petrol, alcohol, natural gas, or other fuels. Engine 10 may be controlled at least partially by a control system, including a controller 12, and by input from a human vehicle operator 130 via an input device 132. In this example, input device 132 includes an accelerator pedal and a pedal position sensor 134 for generating a proportional pedal position signal. Cylinder (herein, also "combustion chamber") 14 of engine 10 may include combustion chamber walls 136 with a piston 138 positioned therein. Piston 138 may be coupled to a crankshaft 140 so that reciprocating motion of the piston is translated into rotational motion of the crankshaft. Crankshaft 140 may be coupled to at least one vehicle wheel 55 of vehicle 5 via a transmission 54, as further described below. Further, a starter motor (not shown) may be coupled to crankshaft 140 via a flywheel to enable a starting operation of engine 10.

In some examples, vehicle 5 may be a hybrid vehicle with multiple sources of torque available to one or more vehicle wheels 55. In other examples, vehicle 5 is a conventional vehicle with only an engine or an electric vehicle with only an electric machine(s). In the example shown, vehicle 5 includes engine 10 and an electric machine 52. Electric machine 52 may be a motor or a motor/generator. Crankshaft 140 of engine 10 and electric machine 52 are connected via transmission 54 to vehicle wheels 55 when one or more clutches 56 are engaged. In the depicted example, a first clutch 56 is provided between crankshaft 140 and electric machine 52, and a second clutch 57 is provided between electric machine 52 and transmission 54. Controller 12 may send a signal to an actuator of each clutch 56 to engage or disengage the clutch, so as to connect or disconnect crankshaft 140 from electric machine 52 and the components connected thereto, and/or connect or disconnect electric machine 52 from transmission 54 and the components connected thereto. Transmission 54 may be a gearbox, a planetary gear system, or another type of transmission.

The powertrain may be configured in various manners, including as a parallel, a series, or a series-parallel hybrid vehicle. In electric vehicle examples, a system battery 58 may be a traction battery that delivers electrical power to electric machine 52 to provide torque to vehicle wheels 55. In some examples, electric machine 52 may also be operated as a generator to provide electrical power to charge system battery 58, for example, during a braking operation. It will be appreciated that in other examples, including non-electric vehicle examples, system battery 58 may be a typical starting, lighting, ignition (SLI) battery coupled to an alternator 46.

Alternator 46 may be configured to charge system battery 58 using engine torque via crankshaft 140 during engine running. In addition, alternator 46 may power one or more electrical systems of the engine, such as one or more auxiliary systems including a heating, ventilation, and air conditioning (HVAC) system, vehicle lights, an on-board entertainment system, and other auxiliary systems based on their corresponding electrical demands. In one example, a current drawn on the alternator may continually vary based on each of an operator cabin cooling demand, a battery charging requirement, other auxiliary vehicle system demands, and motor torque. A voltage regulator may be coupled to alternator 46 in order to regulate the power output of the alternator based upon system usage requirements, including auxiliary system demands.

Cylinder 14 of engine 10 can receive intake air via a series of intake passages 142 and 144 and an intake manifold 146. Intake manifold 146 can communicate with other cylinders of engine 10 in addition to cylinder 14. One or more of the intake passages may include one or more boosting devices, such as a turbocharger or a supercharger. For example, FIG. 1 shows engine 10 configured with a turbocharger, including a compressor 174 arranged between intake passages 142 and 144 and an exhaust turbine 176 arranged along an exhaust passage 135. Compressor 174 may be at least partially powered by exhaust turbine 176 via a shaft 180 when the boosting device is configured as a turbocharger. However, in other examples, such as when engine 10 is provided with a supercharger, compressor 174 may be powered by mechanical input from a motor or the engine and exhaust turbine 176 may be optionally omitted. In still other examples, engine 10 may be provided with an electric supercharger (e.g., an "eBooster"), and compressor 174 may be driven by an electric motor. In still other examples, engine 10 may not be provided with a boosting device, such as when engine 10 is a naturally aspirated engine.

A throttle 162 including a throttle plate 164 may be provided in the engine intake passages for varying a flow rate and/or pressure of intake air provided to the engine cylinders. For example, throttle 162 may be positioned downstream of compressor 174, as shown in FIG. 1, or may be alternatively provided upstream of compressor 174. A position of throttle 162 may be communicated to controller 12 via a signal from a throttle position sensor 163.

Exhaust system 11 includes an exhaust manifold 148 that can receive exhaust gases from other cylinders of engine 10 in addition to cylinder 14. An upstream exhaust gas sensor 126 (e.g., feed gas oxygen sensor) is shown coupled to exhaust manifold 148 upstream of an emission control device 178 (e.g., three way catalyst). Exhaust gas sensor 126 may be selected from among various suitable sensors for providing an indication of an exhaust gas air/fuel ratio (AFR), such as a wide band linear oxygen sensor or UEGO (universal or wide-range exhaust gas oxygen), a two-state oxygen sensor or EGO, a HEGO (heated EGO), a NOx, a HC, or a CO sensor, for example. In the example of FIG. 1, exhaust gas sensor 126 is a UEGO sensor. Emission control device 178 may be a three-way catalyst, a NOx trap, various other emission control devices, or combinations thereof. In the example of FIG. 1, emission control device 178 is a three-way catalyst. Catalyst monitor sensor (CMS) 158 (e.g., a two-state downstream oxygen sensor) is positioned downstream of emissions control device 178 and upstream of atmosphere 159.

Each cylinder of engine 10 may include one or more intake valves and one or more exhaust valves. For example, cylinder 14 is shown including at least one intake poppet valve 150 and at least one exhaust poppet valve 156 located at an upper region of cylinder 14. In some examples, each cylinder of engine 10, including cylinder 14, may include at least two intake poppet valves and at least two exhaust poppet valves located at an upper region of the cylinder. In this example, intake valve 150 may be controlled by controller 12 by cam actuation via cam actuation system 152, including one or more cams 151. Similarly, exhaust valve 156 may be controlled by controller 12 via cam actuation system 154, including one or more cams 153. The position of intake valve 150 and exhaust valve 156 may be determined by valve position sensors (not shown) and/or camshaft position sensors 155 and 157, respectively.

During some conditions, controller 12 may vary the signals provided to cam actuation systems 152 and 154 to control the opening and closing of the respective intake and exhaust valves. The intake and exhaust valve timing may be controlled concurrently, or any of a possibility of variable intake cam timing, variable exhaust cam timing, dual independent variable cam timing, or fixed cam timing may be used. Each cam actuation system may include one or more cams and may utilize one or more of variable displacement engine (VDE), cam profile switching (CPS), variable cam timing (VCT), variable valve timing (VVT), and/or variable valve lift (VVL) systems that may be operated by controller 12 to vary valve operation. In alternative examples, intake valve 150 and/or exhaust valve 156 may be controlled by electric valve actuation. For example, cylinder 14 may alternatively include an intake valve controlled via electric valve actuation and an exhaust valve controlled via cam actuation, including CPS and/or VCT systems. In other examples, the intake and exhaust valves may be controlled by a common valve actuator (or actuation system) or a variable valve timing actuator (or actuation system).

As further described herein, intake valve 150 and exhaust valve 156 may be deactivated during VDE mode via electrically actuated rocker arm mechanisms. In another example, intake valve 150 and exhaust valve 156 may be deactivated via a CPS mechanism in which a cam lobe with no lift is used for deactivated valves. Still other valve deactivation mechanisms may also be used, such as for electrically actuated valves. In one example, deactivation of intake valve 150 may be controlled by a first VDE actuator (e.g., a first electrically actuated rocker arm mechanism, coupled to intake valve 150) while deactivation of exhaust valve 156 may be controlled by a second VDE actuator (e.g., a second electrically actuated rocker arm mechanism, coupled to exhaust valve 156). In alternate examples, a single VDE actuator may control deactivation of both intake and exhaust valves of the cylinder. In still other examples, a single cylinder valve actuator deactivates a plurality of cylinders (both intake and exhaust valves), such as all of the cylinders in an engine bank, or a distinct actuator may control deactivation for all of the intake valves while another distinct actuator controls deactivation for all of the exhaust valves of the deactivated cylinders. It will be appreciated that if the cylinder is a non-deactivatable cylinder of the VDE engine, then the cylinder may not have any valve deactivating actuators. Each engine cylinder may include the valve control mechanisms described herein. Intake and exhaust valves are held in closed positions over one or more engine cycles when deactivated so as to prevent flow into or out of cylinder 14.

Cylinder 14 can have a compression ratio, which is a ratio of volumes when piston 138 is at bottom dead center (BDC) to top dead center (TDC). In one example, the compression ratio is in the range of 9:1 to 10:1. However, in some examples where different fuels are used, the compression ratio may be increased. This may happen, for example, when higher octane fuels or fuels with a higher latent enthalpy of vaporization are used. The compression ratio may also be increased if direct injection is used due to its effect on engine knock.

Each cylinder of engine 10 may include a spark plug 192 for initiating combustion. An ignition system 190 can provide an ignition spark to combustion chamber 14 via spark plug 192 in response to a spark advance signal from controller 12, under select operating modes. Spark timing may be adjusted based on engine operating conditions and driver torque demand. For example, spark may be provided at minimum spark advance for best torque (MBT) timing to maximize engine power and efficiency. Controller 12 may input engine operating conditions, including engine speed, engine load, and exhaust gas AFR, into a look-up table and output the corresponding MBT timing for the input engine operating conditions. In other examples, spark may be retarded from MBT, such as to expedite catalyst warm-up during engine start or to reduce an occurrence of engine knock.

In some examples, each cylinder of engine 10 may be configured with one or more fuel injectors for providing fuel thereto. As a non-limiting example, cylinder 14 is shown including a direct fuel injector 166 and a port fuel injector 66. Fuel injectors 166 and 66 may be configured to deliver fuel received from a fuel system 8. Fuel system 8 may include one or more fuel tanks, fuel pumps, and fuel rails. Fuel injector 166 is shown coupled directly to cylinder 14 for injecting fuel directly therein in proportion to a pulse width of a signal received from controller 12. Port fuel injector 66 may be controlled by controller 12 in a similar way. In this manner, fuel injector 166 provides what is known as direct injection (hereafter also referred to as "DI") of fuel into cylinder 14. While FIG. 1 shows fuel injector 166 positioned to one side of cylinder 14, fuel injector 166 may alternatively be located overhead of the piston, such as near the position of spark plug 192. Such a position may increase mixing and combustion when operating the engine with an alcohol-based fuel due to the lower volatility of some alcohol-based fuels. Alternatively, the injector may be located overhead and near the intake valve to increase mixing. Fuel may be delivered to fuel injectors 166 and 66 from a fuel tank of fuel system 8 via fuel pumps and fuel rails. Further, the fuel tank may have a pressure transducer providing a signal to controller 12.

Fuel injectors 166 and 66 may be configured to receive different fuels from fuel system 8 in varying relative amounts as a fuel mixture and further configured to inject this fuel mixture directly into cylinder. For example, fuel injector 166 may receive alcohol fuel and fuel injector 66 may receive gasoline. Further, fuel may be delivered to cylinder 14 during different strokes of a single cycle of the cylinder. For example, directly injected fuel may be delivered at least partially during a previous exhaust stroke, during an intake stroke, and/or during a compression stroke. Port injected fuel may be injected after intake valve closing of a previous cycle of the cylinder receiving fuel and up until intake valve closing of the present cylinder cycle. As such, for a single combustion event (e.g., combustion of fuel in the cylinder via spark ignition), one or multiple injections of fuel may be performed per cycle via either or both injectors. The multiple DI injections may be performed during the compression stroke, intake stroke, or any appropriate combination thereof in what is referred to as split fuel injection.

Fuel tanks in fuel system 8 may hold fuels of different fuel types, such as fuels with different fuel qualities and different fuel compositions. The differences may include different alcohol content, different water content, different octane, different heats of vaporization, different fuel blends, and/or combinations thereof, etc. One example of fuels with different heats of vaporization includes gasoline as a first fuel type with a lower heat of vaporization and ethanol as a second fuel type with a greater heat of vaporization. In another example, the engine may use gasoline as a first fuel type and an alcohol-containing fuel blend, such as E85 (which is approximately 85% ethanol and 15% gasoline) or M85 (which is approximately 85% methanol and 15% gasoline), as a second fuel type. Other feasible substances include water, methanol, a mixture of alcohol and water, a mixture of water and methanol, a mixture of alcohols, etc. In still another example, both fuels may be alcohol blends with varying alcohol compositions, wherein the first fuel type may be a gasoline alcohol blend with a lower concentration of alcohol, such as E10 (which is approximately 10% ethanol), while the second fuel type may be a gasoline alcohol blend with a greater concentration of alcohol, such as E85 (which is approximately 85% ethanol). Additionally, the first and second fuels may also differ in other fuel qualities, such as a difference in temperature, viscosity, octane number, etc. Moreover, fuel characteristics of one or both fuel tanks may vary frequently, for example, due to day to day variations in tank refilling.

Controller 12 is shown in FIG. 1 as a microcomputer, including a microprocessor unit 106, input/output ports 108, an electronic storage medium for executable programs (e.g., executable instructions) and calibration values shown as non-transitory read-only memory chip 110 in this particular example, random access memory 112, keep alive memory 114, and a data bus. Controller 12 may receive various signals from sensors coupled to engine 10, including signals previously discussed and additionally including a measurement of inducted mass air flow (MAF) from a mass air flow sensor 122; an engine coolant temperature (ECT) from a temperature sensor 116 coupled to a cooling sleeve 118; a crankshaft position signal from a Hall effect sensor 120 (or other type) coupled to crankshaft 140; throttle position from a throttle position sensor 163; signal UEGO from exhaust gas sensor 126, which may be used by controller 12 to determine the air-fuel ratio of the exhaust gas; engine vibrations (e.g., knock) via knock sensor 90; and an absolute manifold pressure signal (MAP) from a MAP sensor 124. An engine speed signal, RPM, may be generated by controller 12 from crankshaft position. The manifold pressure signal MAP from MAP sensor 124 may be used to provide an indication of vacuum or pressure in the intake manifold. Controller 12 may infer an engine temperature based on the engine coolant temperature and infer a temperature of emission control device 178.

As described above, FIG. 1 shows only one cylinder of a multi-cylinder engine. As such, each cylinder may similarly include its own set of intake/exhaust valves, fuel injector(s), spark plug, etc. It will be appreciated that engine 10 may include any suitable number of cylinders, including 2, 3, 4, 5, 6, 8, 10, 12, or more cylinders. Further, each of these cylinders can include some or all of the various components described and depicted by FIG. 1 with reference to cylinder 14.

During selected conditions, such as when the full torque capability of engine 10 is not requested, one of a first or a second cylinder group may be selected for deactivation by controller 12 (herein also referred to as a VDE mode of operation). During the VDE mode, cylinders of the selected group of cylinders may be deactivated by shutting off respective fuel injectors 166 and 66. Further, valves 150 and 156 may be deactivated and held closed over one or more engine cycles. While fuel injectors of the disabled cylinders are turned off, the remaining enabled cylinders continue to carry out combustion, with corresponding fuel injectors and intake and exhaust valves active and operating. To meet torque requirements, the controller adjusts the amount of air entering active engine cylinders. Thus, to provide equivalent engine torque that an eight cylinder engine produces at 0.2 engine load and a particular engine speed, the active engine cylinders may operate at higher pressures than engine cylinders when the engine is operated with all engine cylinders being active. This requires higher manifold pressures, resulting in lowered pumping losses and increased engine efficiency. Additionally, the lower effective surface area (from only the active cylinders) exposed to combustion reduces engine heat losses, increasing the thermal efficiency of the engine.

Thus, the system of FIG. 1 provides for a system for operating an engine, comprising: an internal combustion engine including an actuator; an exhaust system coupled to the internal combustion engine, the exhaust system including a first oxygen sensor, a second oxygen sensor, and a catalyst; and a controller including executable instructions stored in non-transitory memory to adjust a parameter of a digital filter, the digital filter applied to output of the first oxygen sensor, a value of the parameter based on a time constant of the second oxygen sensor, and additional instructions to adjust an air-fuel ratio of the engine responsive to output of the digital filter. The system includes where the first oxygen sensor is located upstream of the catalyst. The system includes where the second oxygen sensor is located downstream of the catalyst. The system includes where the digital filter is a low pass digital filter. The system further comprises additional instructions to determine the time constant from a voltage output via the second oxygen sensor. The system further comprises additional instructions to determine a catalyst index ratio from output of the digital filter.

Referring now to FIG. 2, prophetic plots of histograms of catalyst index ratio values for full useful life catalysts and histograms of catalyst index ratio values for threshold catalysts according to a prior art method are shown. The histograms are incorporated into plots that show catalyst index ratio histograms for when the catalyst index ratio values are determined from several different levels of degraded CMS sensors. Full useful life catalysts are catalysts that meet emissions standards for a predetermined defined vehicle life cycle duration (e.g., 150,000 miles driven by the vehicle). Threshold catalysts are catalysts with performance levels within a specified range beyond the pre-determined maximum emissions standard for that vehicle. Vertical line 250 represents a threshold catalyst index ratio. The catalyst may be determined to be degraded if the index ratio for the catalyst is greater than the threshold value. The histograms of each plot are based on histograms for catalyst index ratios determined using the same full useful life catalyst and threshold catalyst for each plot. The differences in the plots reflect the differences in CMS sensor degradation between the plots.

The first plot from the top of FIG. 2 is a plot showing a catalyst index ratio histogram for a full useful life catalyst and a catalyst index ratio histogram for a threshold catalyst as determined from output of a CMS sensor that is not degraded. The vertical axis represents an actual number of catalyst index ratio values recorded in each bin (e.g., vertical bar) of each catalyst index ratio histogram. The horizontal axis represents catalyst index ratio value. Histogram 202 represents a catalyst index ratio histogram for a full useful life catalyst when the catalyst index ratio for the full useful life catalyst is determined via a non-degraded CMS sensor. Histogram 203 represents a catalyst index ratio histogram for a threshold catalyst when the catalyst index ratio for the threshold catalyst is determined via a non-degraded CMS sensor.

It may be observed that there is significant separation between the index ratio values for the catalyst index ratio histogram for a full useful life catalyst and the catalyst index ratio histogram for a threshold catalyst. Further, the catalyst index ratio histogram for a threshold catalyst 203 is much greater than threshold 250 so that a threshold catalyst may be easily determined via the catalyst index ratio when the CMS sensor is not degraded. Catalyst index ratios near a value of one indicate that the catalyst is degraded and catalyst values nearer to zero indicate a functioning catalyst.

The second plot from the top of FIG. 2 is a plot showing a catalyst index ratio histogram for a full useful life catalyst and a catalyst index ratio histogram for a threshold catalyst as determined from output of a CMS sensor that exhibits a small amount of degradation (e.g., the time constant of the CMS sensor is 0.1 seconds). The vertical axis represents an actual number of catalyst index ratio values recorded in each bin (e.g., vertical bar) of each histogram. The horizontal axis represents catalyst index ratio value. Histogram 204 represents a histogram for a full useful life catalyst when the catalyst index ratio for the full useful life catalyst is determined via CMS sensor exhibiting a small amount of degradation. Histogram 205 represents a catalyst index ratio histogram for a threshold catalyst when the catalyst index ratio for the threshold catalyst is determined via the CMS sensor exhibiting a small amount of degradation.

It may be observed that histogram 205 has shifted left toward the threshold 250. This shift is related to the filtered like response of the mildly degraded CMS sensor. The shift provides less distance between threshold 250 and the histogram 205 as compared to histogram 203 such that there may be less confidence in indicating a degraded catalyst due to the degraded CMS sensor affecting the catalyst index ratio values.

The third plot from the top of FIG. 2 is a plot showing a catalyst index ratio histogram for a full useful life catalyst and a catalyst index ratio histogram for a threshold catalyst as determined from output of a CMS sensor that exhibits a lower medium amount of degradation (e.g., the time constant of the CMS sensor is 0.2 seconds). The vertical axis represents an actual number of catalyst index ratio values recorded in each bin (e.g., vertical bar) of each histogram. The horizontal axis represents catalyst index ratio value. Histogram 206 represents a histogram for a full useful life catalyst when the catalyst index ratio for the full useful life catalyst is determined via CMS sensor exhibiting a lower medium amount of degradation. Histogram 207 represents a catalyst index ratio histogram for a threshold catalyst when the catalyst index ratio for the threshold catalyst is determined via the CMS sensor exhibiting a lower medium amount of degradation.

It may be observed that histogram 207 has shifted further left toward the threshold 250. This shift is again related to the filtered like response of the lower middle level degraded CMS sensor. The shift provides less distance between threshold 250 and histogram 207 as compared to histogram 205 such that there may be even less confidence in indicating a degraded catalyst due to the degraded CMS sensor affecting the catalyst index ratio values.

The fourth plot from the top of FIG. 2 is a plot showing a catalyst index ratio histogram for a full useful life catalyst and a catalyst index ratio histogram for a threshold catalyst as determined from output of a CMS sensor that exhibits a higher medium amount of degradation (e.g., the time constant of the CMS sensor is 0.3 seconds). The vertical axis represents an actual number of catalyst index ratio values recorded in each bin (e.g., vertical bar) of each histogram. The horizontal axis represents catalyst index ratio value. Histogram 208 represents a catalyst index ratio histogram for a full useful life catalyst when the catalyst index ratio for the full useful life catalyst is determined via a CMS sensor exhibiting a higher medium amount of degradation. Histogram 209 represents a catalyst index ratio histogram for a threshold catalyst when the catalyst index ratio for the threshold catalyst is determined via the CMS sensor exhibiting a higher medium amount of degradation.

It may be observed that histogram 209 has shifted further left toward the threshold 250. This shift is again related to the filtered like response of the higher middle level degraded CMS sensor. The shift provides less distance between threshold 250 and histogram 209 as compared to histogram 207 such that there may be even less confidence in indicating a degraded catalyst due to the degraded CMS sensor affecting the catalyst index ratio values. Further, the threshold 250 has to be adjusted to a lower value to prevent a threshold catalyst from being judged to be not degraded.

The fifth plot from the top of FIG. 2 is a plot showing a catalyst index ratio histogram for a full useful life catalyst and a catalyst index ratio histogram for a threshold catalyst as determined from output of a CMS sensor that exhibits a high amount of degradation (e.g., the time constant of the CMS sensor is 0.5 seconds). The vertical axis represents an actual number of catalyst index ratio values recorded in each bin (e.g., vertical bar) of each histogram. The horizontal axis represents catalyst index ratio value. Histogram 210 represents a catalyst index ratio histogram for a full useful life catalyst when the catalyst index ratio for the full useful life catalyst is determined via a CMS sensor exhibiting a high level of degradation. Histogram 211 represents a catalyst index ratio histogram for a threshold catalyst when the catalyst index ratio for the threshold catalyst is determined via the CMS sensor exhibiting a high amount of degradation.

It may be observed that histogram 211 has shifted further left toward the threshold 250. This shift is again related to the filtered like response of the higher level degraded CMS sensor. The shift provides less distance between threshold 250 and histogram 211 as compared to histogram 209 such that there may be even less confidence in indicating a degraded catalyst due to the degraded CMS sensor affecting the catalyst index ratio values. Further, the threshold 250 has to be adjusted even further to a lower value to prevent a threshold catalyst from being judged to be not degraded.

Thus, it may be observed that threshold 250 has to be adjusted responsive to CMS sensor degradation to prevent a threshold catalyst from being judged to be not degraded. Further, it becomes more and more difficult to ensure that a catalyst is properly diagnosed because separation between histograms for the full useful life catalyst and the threshold catalyst is reduced.

Referring now to FIG. 3, prophetic plots of histograms of catalyst index ratio values for full useful life catalysts and histograms of catalyst index ratio values for threshold catalysts according to the present method are shown. The histograms are incorporated into plots that show catalyst index ratio histograms for when the catalyst index ratio values are determined from several different levels of degraded CMS sensors. Full useful life catalysts are catalysts that meet emissions standards for a predetermined defined vehicle life cycle duration (e.g., 150,000 miles driven by the vehicle). Threshold catalysts are catalysts with performance levels within a specified range beyond the pre-determined maximum emissions standard for that vehicle. Vertical line 350 represents a threshold catalyst index ratio. The catalyst may be determined to be degraded if the index ratio for the catalyst is greater than the threshold value, 0.3 in this example. The histograms of each plot are based on histograms for catalyst index ratios determined using the same full useful life catalyst and threshold catalyst for each plot. The differences in the plots reflect the differences in CMS sensor degradation between the plots. Histograms shown in FIG. 3 are determined via calculating the catalyst index ratio as described in the method of FIG. 4. Further, the catalysts for determining the catalyst index ratios in FIG. 3 are the same as those applied in FIG. 2.

The first plot from the top of FIG. 3 is a plot showing a catalyst index ratio histogram for a full useful life catalyst and a catalyst index ratio histogram for a threshold catalyst as determined from output of a CMS sensor that is not degraded. The vertical axis represents an actual number of catalyst index ratio values recorded in each bin (e.g., vertical bar) of each catalyst index ratio histogram. The horizontal axis represents catalyst index ratio value. Histogram 302 represents a catalyst index ratio histogram for a full useful life catalyst when the catalyst index ratio for the full useful life catalyst is determined via a non-degraded CMS sensor.

Histogram 303 represents a catalyst index ratio histogram for a threshold catalyst when the catalyst index ratio for the threshold catalyst is determined via a non-degraded CMS sensor.

It may be observed that there is significant separation between the index ratio values for the catalyst index ratio histogram for a full useful life catalyst and the catalyst index ratio histogram for a threshold catalyst. Further, the catalyst index ratio histogram for a threshold catalyst 303 is much greater than threshold 350 so that a threshold catalyst may be easily determined via the catalyst index ratio when the CMS sensor is not degraded. Catalyst index ratios near a value of one indicate that the catalyst is degraded and catalyst values nearer to zero indicate a functioning catalyst.

The second plot from the top of FIG. 3 is a plot showing a catalyst index ratio histogram for a full useful life catalyst and a catalyst index ratio histogram for a threshold catalyst as determined from output of a CMS sensor that exhibits a small amount of degradation (e.g., the time constant of the CMS sensor is 0.1 seconds). The vertical axis represents an actual number of catalyst index ratio values recorded in each bin (e.g., vertical bar) of each histogram. The horizontal axis represents catalyst index ratio value. Histogram 304 represents a histogram for a full useful life catalyst when the catalyst index ratio for the full useful life catalyst is determined via a CMS sensor exhibiting a small amount of degradation. Histogram 305 represents a catalyst index ratio histogram for a threshold catalyst when the catalyst index ratio for the threshold catalyst is determined via the CMS sensor exhibiting a small amount of degradation.

It may be observed that histogram 305 has shifted left toward the threshold 350. This shift is related to the filtered like response of the mildly degraded CMS sensor. The shift provides less distance between threshold 350 and the histogram 305 as compared to histogram 303 such that there may be less confidence in indicating a degraded catalyst due to the degraded CMS sensor affecting the catalyst index ratio values. However, there remains enough separation between the histogram for the full useful life catalyst and the histogram for the threshold catalyst to provide a catalyst assessment with a high confidence level.

The third plot from the top of FIG. 3 is a plot showing a catalyst index ratio histogram for a full useful life catalyst and a catalyst index ratio histogram for a threshold catalyst as determined from output of a CMS sensor that exhibits a lower medium amount of degradation (e.g., the time constant of the CMS sensor is 0.2 seconds). The vertical axis represents an actual number of catalyst index ratio values recorded in each bin (e.g., vertical bar) of each histogram. The horizontal axis represents catalyst index ratio value. Histogram 306 represents a histogram for a full useful life catalyst when the catalyst index ratio for the full useful life catalyst is determined via a CMS sensor exhibiting a lower medium amount of degradation. Histogram 307 represents a catalyst index ratio histogram for a threshold catalyst when the catalyst index ratio for the threshold catalyst is determined via the CMS sensor exhibiting a lower medium amount of degradation.

It may be observed that histogram 307 has shifted further left toward the threshold 350. This shift is again related to the filtered like response of the lower middle level degraded CMS sensor. The shift provides less distance between threshold 350 and histogram 307 as compared to histogram 305 such that there may be even less confidence in indicating a degraded catalyst due to the degraded CMS sensor affecting the catalyst index ratio values. Nevertheless, there remains enough separation between the histogram for the full useful life catalyst and the histogram for the threshold catalyst to provide a catalyst assessment with a high confidence level.

The fourth plot from the top of FIG. 3 is a plot showing a catalyst index ratio histogram for a full useful life catalyst and a catalyst index ratio histogram for a threshold catalyst as determined from output of a CMS sensor that exhibits a higher medium amount of degradation (e.g., the time constant of the CMS sensor is 0.3 seconds). The vertical axis represents an actual number of catalyst index ratio values recorded in each bin (e.g., vertical bar) of each histogram. The horizontal axis represents catalyst index ratio value. Histogram 308 represents a catalyst index ratio histogram for a full useful life catalyst when the catalyst index ratio for the full useful life catalyst is determined via a CMS sensor exhibiting a higher medium amount of degradation. Histogram 309 represents a catalyst index ratio histogram for a threshold catalyst when the catalyst index ratio for the threshold catalyst is determined via the CMS sensor exhibiting a higher medium amount of degradation.

It may be observed that histogram 309 is not shifted further left toward the threshold 350. Rather, histogram 309 is near the same catalyst index level as histogram 307. By low-pass filtering output of the feed gas oxygen sensor, it may be possible to limit the shifting of the catalyst index ratio due to CMS sensor degradation. This allows threshold 350 to remain at a constant value of 0.3 even though CMS sensor degradation is present. In addition, there remains enough separation between the histogram for the full useful life catalyst and the histogram for the threshold catalyst to provide a catalyst assessment with a high confidence level.

The fifth plot from the top of FIG. 3 is a plot showing a catalyst index ratio histogram for a full useful life catalyst and a catalyst index ratio histogram for a threshold catalyst as determined from output of a CMS sensor that exhibits a high amount of degradation (e.g., the time constant of the CMS sensor is 0.5 seconds). The vertical axis represents an actual number of catalyst index ratio values recorded in each bin (e.g., vertical bar) of each histogram. The horizontal axis represents catalyst index ratio value. Histogram 310 represents a catalyst index ratio histogram for a full useful life catalyst when the catalyst index ratio for the full useful life catalyst is determined via a CMS sensor exhibiting a high level of degradation. Histogram 311 represents a catalyst index ratio histogram for a threshold catalyst when the catalyst index ratio for the threshold catalyst is determined via the CMS sensor exhibiting a high amount of degradation.

It may be observed that histogram 311 is not shifted further left toward the threshold 350. Instead, histogram 311 is near the same catalyst index level as histograms 307 and 309. In addition, threshold 350 remains at a constant value of 0.3 even though additional CMS sensor degradation is present. Further, there remains enough separation between the histogram for the full useful life catalyst and the histogram for the threshold catalyst to provide a catalyst assessment with a high confidence level.

Thus, it may be observed that threshold 350 may remain a constant value whether the CMS sensor is new or degraded. In addition, there is sufficient separation between the histograms for full useful life catalysts and histograms for the threshold catalysts, which allows catalyst assessments with a high confidence level.

Referring now to FIG. 4, a method for operating an engine is shown. The method of FIG. 4 may be included in and may cooperate with the system of FIG. 1. At least portions of method 400 may be incorporated in the system of FIG. 1 as executable instructions stored in non-transitory memory. In addition, other portions of method 400 may be performed via a controller transforming operating states of devices and actuators in the physical world. The controller may employ engine actuators of the engine system to adjust engine operation. Further, method 400 may determine selected control parameters from sensor inputs. The method of FIG. 4 may be applied to each of the engine's cylinder banks and exhaust systems coupled to the engine's cylinder banks.

At 402, method 400 determines vehicle and engine operating conditions via the sensors described in FIG. 1. Method 400 may determine operating conditions including but not limited to engine speed, engine load, engine temperature, ambient temperature, fuel injection timing, knock sensor output, fuel injection timing for DI and port injectors, engine position, poppet valve opening and closing timing, driver demand torque, and engine air flow. Method 400 proceeds to 404.

At 404, method 400 judges if deceleration fuel shut-off (DFSO) conditions have been met and if CMS oxygen sensor time constant characterization is desired. DFSO conditions being met may include but are not limited to driver demand torque being less than a threshold torque and vehicle speed being greater than a threshold vehicle speed.

The CMS oxygen sensor time constant is a parameter that describes CMS oxygen sensor output responsive to a step change in engine air-fuel ratio that is reflected in combustion byproducts in the engine's exhaust system. Over time and engine operating conditions, output of a CMS oxygen sensor may be less responsive to changes in exhaust gas constituents (e.g., oxygen levels). For example, the CMS oxygen sensor output may be similar to that of a first order low pass filter when the CMS oxygen sensor responds to a step change in exhaust gas oxygen concentration. From time to time (e.g., every time the vehicle travels a predetermined distance or when the engine meets DFSO conditions one time during a trip by the vehicle) a time constant characterization of one or more CMS sensors may be desired. The time constant characterization of the CMS sensor allows output of the feed gas oxygen sensor to be filtered so that the feed gas oxygen sensor output response is closer to that of the CMS sensor that is associated with the feed gas oxygen sensor. By compensating the feed gas oxygen sensor output via a low pass filter that approximates the response characteristics of the CMS oxygen sensor, it may be possible to generate catalyst index ratio values that are more representative of catalyst performance rather than CMS oxygen sensor performance. If method 400 judges that DFSO conditions have been met and CMS oxygen sensor time constant characterization is desired, the answer is yes and method 400 proceeds to 406. Otherwise, the answer is no and method 400 proceeds to 414.

At 406, method 400 samples output voltage from the CMS sensor of a cylinder bank via a analog to digital converter of the controller and stores the voltage level to memory. The CMS sensor output voltage may be sampled at a predetermined time interval (e.g., every 100 milliseconds). In addition, method 400 may operate the engine rich for a period of time to cause the output of the CMS sensor to indicate rich exhaust gases. Method 400 proceeds to 408.

At 408, method 400 ceases to inject fuel to cylinders of the cylinder bank associated with the CMS sensor that is being characterized. By ceasing to inject fuel to the cylinder bank, the engine ceases combustion but pumps air through the engine. The air flows through the engine and the exhaust system where it eventually changes the state of the oxygen sensor from rich to lean. The engine continues to rotate via energy supplied from the vehicle's wheels even though at least one bank of engine cylinders are not combusting fuel. By changing the state of the CMS sensor, it may be possible to characterize the time constant of the CMS sensor. Method 400 proceeds to 410 after ceasing combustion in engine cylinders and pumping air that has not participated in combustion within the engine through the engine and the exhaust system.

At 410, method 400 determines or estimates a time constant of the CMS sensor. In one example, method 400 calculates a slope of the voltage change of the CMS sensor caused by changing the engine from rich air-fuel ratio operation to lean air-fuel ratio operation. For example, method 400 may perform a least squares fit to CMS sensor data output voltages between a voltage that represents rich exhaust gas constituents and a voltage that represents lean exhaust gas constituents. The least squares fit is to the equation y=mx+b where y is the output variable, x is the input variable, m is the slope of the straight line, and b is the offset of the straight line. The slope and offset values may be found via the following equations:

$$m = \frac{\sum_{i=1}^{n}(x_i - \overline{X})(y_i - \overline{Y})}{\sum_{i=1}^{n}(x_i - \overline{X})^2}$$

$$b = \overline{Y} - m\overline{X}$$

where $x_i$ is the ith sample of the variable x (time), $y_i$ is the ith sample of variable y (CMS voltage), $\overline{X}$ is the mean value of x, $\overline{Y}$ is the mean value of y, and n is the total number of CMS voltage samples taken. The slope may then be converted into a CMS time constant value via indexing or referencing a table or function of CMS time constant values via the slope value. The values in the table may be empirically determined via switching an oxygen sensor from rich to lean, calculating the slope values, and calculating the time constant value for the CMS sensor from the same data by determining the roughly 63% of an amount of time it takes for the CMS sensor to switch from a voltage that indicates rich exhaust gases to a voltage that indicates lean exhaust gases. The time constants may be stored in the table or function according to the slope of the CMS sensor output voltage that is associated with the determined CMS time constant value. Alternatively, method 400 may estimate the CMS sensor time constant by determining roughly 63% of an amount of time it takes for the CMS sensor to switch from a voltage that indicates rich exhaust gases to a voltage that indicates lean exhaust gases. Method 400 proceeds to 412 after determining the CMS sensor time constant value.

At 412, method 400 judges if DFSO conditions are still met. If method 400 judges that DFSO conditions are still met, method 400 returns to 406. If method 400 judges that DFSO conditions are not met, the answer is no and method 400 proceeds to 414.

At 414, method 400 determines if it is desirable to assess whether or not the vehicle's catalyst is meeting performance objectives. In one example, method 400 may judge to assess catalyst performance once each vehicle drivel cycle. In other examples, method 400 may judge to assess catalyst performance after the vehicle travels a predetermined distance. If method 400 judges that a catalyst performance assessment is not desired, the answer is no and method 400 proceeds to 430. Otherwise, method 400 judges that a catalyst performance assessment is desired and method 400 proceeds to 416.

At 416, method 400 adjusts the engine's air-fuel ratio to provide an air fuel mixture that oscillates about a stoichiometric air-fuel ratio. In one example, driver demand torque is converted into an engine air amount and the engine air amount is multiplied by an air-fuel ratio that provides a stoichiometric air-fuel ratio. The stoichiometric air fuel ratio is then modified by adding proportional and integral fuel adjustment amounts to an amount of fuel that provides the stoichiometric air-fuel ratio. The proportional and integral fuel adjustment amounts may be dependent or based on feedback from the engine's feed gas oxygen sensors. For example, the engine air-fuel ratio may be ramped rich until the feed gas oxygen sensor indicate rich exhaust gases, then the engine air-fuel ratio may be adjusted leaner and then ramped yet leaner until the feed gas oxygen sensor indicates lean exhaust gases, then the engine air-fuel ratio may be adjusted richer and then ramped yet richer until the feed gas oxygen sensor indicates rich exhaust gases. This process may be repeatedly performed to cycle the engine's air-fuel ratio about a stoichiometric air-fuel ratio. Method 400 proceeds to 418.

At 418, method 400 applies a low-pass filter to the output of the feed gas oxygen sensor that is associated with the CMS sensor (e.g., oxygen sensors of a same cylinder bank). However, the feed gas oxygen sensor output may be first converted into an output similar to EGO sensor output. In particular, the output voltage of the feed gas oxygen sensor may be converted from a voltage that changes linearly with engine air-fuel ratio indicated via exhaust gas oxygen concentration to a voltage that changes nearly in a two state fashion with engine air-fuel ratio as indicated by exhaust gas oxygen concentration (e.g., UEGO sensor output may be converted to EGO sensor type output). The modified feed gas oxygen sensor output may then be low-pass filtered.

The low-pass filter has a time constant that is equivalent to the time constant that was estimated for the CMS sensor at 410. In one example, the low-pass filter is of the form $y(i)=(1-\alpha)y(i-1)+\alpha x(i)$, where i is the sample number, y is the filter output value (e.g., the filtered feed gas oxygen sensor output voltage), x is the filter input value (e.g., the modified feed gas oxygen sensor output voltage), $\alpha$ is a smoothing factor and the smoothing factor may be determined from the CMS time constant $\tau$ via the equation:

$$\alpha = \frac{\frac{\Delta T}{\tau}}{\frac{\Delta T}{\tau} + 1},$$

where $\Delta T$ is the sample period, $\alpha$ is the smoothing factor, and $\tau$ is the CMS sensor time constant. The low-pass filtered modified feed gas oxygen sensor output may then be stored as values in controller memory. Additionally, the output of the CMS sensor is stored to controller memory while the engine air-fuel ratio is oscillating about a stoichiometric air-fuel ratio. Method 400 proceeds to 420.

At 420, method 400 determines a catalyst index ratio. In one example, the catalyst index ratio may be determined for n samples of the feed gas oxygen sensor (e.g., upstream oxygen sensor) and n samples of the CMS oxygen sensor (e.g., downstream oxygen sensor) via the following equation:

$$R = \frac{\sum_{i=1}^{n} \sqrt{(S1_{i+1} - S1_i)^2 + (t_{i+1} - t_i)^2}}{\sum_{i=1}^{n} \sqrt{(S2_{i+1} - S2_i)^2 + (t_{i+1} - t_i)^2}}$$

where R is the catalyst index ratio, i is the sample number, S1 is the CMS oxygen sensor output, S2 is the filtered modified feed gas oxygen sensor output (e.g., y(i) from step 418), t is time. This equation determines a ratio of arc lengths as a basis for determining the presence or absence of catalyst degradation. The numerator approximates a line length generated from the CMS oxygen sensor and the denominator approximates a line length generated from the feed gas oxygen sensor. Method 400 proceeds to 422 after determining the value of the catalyst index ratio.

At 422, method 400 judges if the catalyst index ratio value is greater than (G.T.) a threshold value. The threshold value may be empirically determined via installing threshold catalyst and full useful life catalysts in an engine exhaust system and determining catalyst index ratios for both catalysts. The threshold level may be selected to fall in between index ratio values for the threshold catalyst and index ratio values for the full useful life catalyst. If method 400 judges that the index ratio for the catalyst is greater than the threshold, the answer is yes and method 400 proceeds to 424. Otherwise, the answer is no and method 400 proceeds to exit.

At 424, method 400 adjusts an actuator to compensate for a degraded catalyst. In one example, method 400 may illuminate a light or provide an indication via a display to notify vehicle occupants that vehicle service may be required. In addition, method 400 may adjust the engine's fuel injectors to reduce engine air-fuel ratio peak to peak variation so as to compensate for lower oxygen storage capacity of the degraded catalyst. Further, fuel injectors may be adjusted to increase or decrease an air-fuel ratio oscillation frequency to improve catalyst efficiency. Method 400 may also retard spark timing to reduce engine NOx emissions in the presence of catalyst degradation. Further still, method 400 may make cam timing and valve timing adjustments to compensate for a degraded catalyst. Method 400 proceeds to exit after adjusting one or more actuators in response to an indication of catalyst degradation provided via comparing the catalyst index ratio to a threshold value. Method 400 proceeds to exit.

At 430, method 400 adjusts the engine's air-fuel ratio to provide an air fuel mixture that oscillates about a stoichiometric air-fuel ratio. In one example, driver demand torque is converted into an engine air amount and the engine air amount is multiplied by an air-fuel ratio that provides a stoichiometric air-fuel ratio. The stoichiometric air fuel ratio is then modified by adding proportional and integral fuel adjustment amounts to an amount of fuel that provides the stoichiometric air-fuel ratio. The proportional and integral fuel adjustment amounts may be dependent or based on feedback from the engine's feed gas oxygen sensors. Specifically, the engine air-fuel ratio may be ramped rich until the feed gas oxygen sensor indicates rich exhaust gases, then the engine air-fuel ratio may be adjusted leaner and then ramped yet leaner until the feed gas oxygen sensor indicates lean exhaust gases, then the engine air-fuel ratio may be adjusted richer and then ramped yet richer until the feed gas oxygen sensor indicates rich exhaust gases. This process may be repeatedly performed to cycle the engine's air-fuel ratio about a stoichiometric air-fuel ratio. Method 400 proceeds to exit.

In this way, output of an upstream oxygen sensor may be filtered via a digital low-pass filter with a time constant that is based on a time constant of a downstream oxygen sensor to compensate for downstream oxygen sensor degradation. The low-pass filtering causes an index ratio calculation to shift less toward an index ratio that indicates proper catalyst functioning.

In an alternative example, instead of filtering the feed gas oxygen sensor output voltage via a low-pass (e.g., lag filter), the output voltage of the CMS sensor may be filtered via a filter that includes lead compensation and the feed gas oxygen sensor output voltage may not be filtered or only filtered by a small amount (e.g., small time constant low-pass filter).

Thus, method 400 provides for an engine operating method, comprising: filtering output of an oxygen sensor located upstream of a catalyst in an exhaust system of an engine according to response of an oxygen sensor located downstream of the catalyst; and adjusting an actuator responsive to the filtered output of the oxygen sensor. The method includes where the actuator is a fuel injector and where the fuel injector is adjusted to reduce an amplitude of an engine air-fuel ratio. The method includes where the actuator is a fuel injector and where the fuel injector is adjusted to increase a frequency of an engine air-fuel ratio. The method includes where filtering includes digitally filtering output of the oxygen sensor located upstream of the catalyst. The method includes where filtering includes applying a first order low-pass filter having a time constant or a smoothing factor that is based on output of the oxygen sensor located downstream of the catalyst. The method includes where filtering includes adding a weighted past output of the oxygen sensor located upstream of the catalyst to a weighted present output of the oxygen sensor located upstream of the catalyst. The method includes where the oxygen sensor located upstream of the catalyst is a wide band linear oxygen sensor. The method includes where actuator is an ignition system.

The method of FIG. 4 also provides for an engine operating method, comprising: entering an engine into a fuel cut-off mode; estimating a time constant of an oxygen sensor located downstream of a catalyst in an exhaust system of the engine from output of the oxygen sensor generated while the engine is in the fuel cut-off mode; filtering output of an oxygen sensor located upstream of the catalyst according to response of the oxygen sensor located downstream of the catalyst; and adjusting an actuator responsive to the filtered output of the oxygen sensor located upstream of the catalyst. The method includes where the time constant is estimated according to a change in an output of the oxygen sensor located downstream of the catalyst. The method further comprises generating a length of a line from an output of the oxygen sensor located downstream of the catalyst. The method further comprises generating a length of a line from an output of the oxygen sensor located upstream of the catalyst. The method further comprises determining a catalyst index ratio via the length of the line from the output of the oxygen sensor located downstream of the catalyst and the length of the line from the output of the oxygen sensor located upstream of the catalyst. The method includes where the catalyst index ratio is based on the filtered output of the oxygen sensor located upstream of the catalyst.

Referring now to FIG. 5, an example sequence that illustrates applying a low-pass filter to the output of an upstream oxygen sensor for the purpose of compensating for downstream oxygen sensor degradation is shown. The sequence of FIG. 5 may be provided via the system of FIG. 1 in cooperation with the method of FIG. 4. The plots are time aligned and occur at the same time. In addition, the vertical lines at times t0-t6 represent times of interest during the sequence.

The first plot from the top of FIG. 5 is a plot of engine DFSO state versus time. The vertical axis represents engine DFSO state and the engine is in DFSO when trace 502 is at a higher level near the vertical axis arrow. Trace 502 represents the engine DFSO state. The horizontal axis represents time and time increases from the left side of the plot to the right side of the plot.

The second plot from the top of FIG. 5 is a plot of catalyst monitor state versus time. The vertical axis represents catalyst monitor state and the catalyst is being monitored for desired performance when trace 504 is at a higher level near the vertical axis arrow. Trace 504 represents the catalyst monitor state. The horizontal axis represents time and time increases from the left side of the plot to the right side of the plot.

The third plot from the top of FIG. 5 is a plot of an estimated CMS oxygen sensor time constant value versus time. The vertical axis represents the estimated CMS oxygen sensor time constant value and the value of the estimated CMS oxygen sensor time constant increases in the direction of the vertical axis. Trace 506 represents the estimated CMS oxygen sensor time constant value. The horizontal axis represents time and time increases from the left side of the plot to the right side of the plot.

The fourth plot from the top of FIG. 5 is a plot of a catalyst index ratio (e.g., a measure of catalyst performance) versus time. The vertical axis represents the catalyst index ratio value and the catalyst index ratio value increases in the direction of the vertical axis arrow. Trace 508 represents the catalyst index ratio value. The horizontal axis represents time and time increases from the left side of the plot to the right side of the plot. Line 550 is a threshold index ratio value. The catalyst may be determined to be degraded when the index ratio of the catalyst is greater than threshold 550.

The fifth plot from the top of FIG. 5 is a plot of low-pass filtered modified feed gas or upstream oxygen sensor output voltage versus time. The vertical axis represents low-pass filtered modified feed gas oxygen sensor output voltage and low-pass filtered modified feed gas oxygen sensor output voltage increases in the direction of the vertical axis arrow. Trace 510 represents the low-pass filtered modified feed gas oxygen sensor output voltage. The horizontal axis represents time and time increases from the left side of the plot to the right side of the plot. Line 552 indicates a stoichiometric air-fuel value. The engine operates rich when trace 510 is above threshold 552. The engine operates lean when trace 510 is below threshold 552.

The sixth plot from the top of FIG. 5 is a plot of CMS or downstream oxygen sensor output voltage versus time. The vertical axis represents CMS oxygen sensor output voltage and CMS oxygen sensor output voltage increases in the direction of the vertical axis arrow. Trace 512 represents the CMS oxygen sensor output voltage. The horizontal axis represents time and time increases from the left side of the plot to the right side of the plot. Line 554 indicates a stoichiometric air-fuel value. The exhaust gases downstream of the catalyst indicate rich when trace 512 is above threshold 554. The exhaust gases downstream of the catalyst indicate lean when trace 512 is below threshold 554.

At time t0, the engine is operating and it is not in DFSO mode. The catalyst monitor is not activated and the CMS sensor time constant τ is a smaller value, such that the feed gas oxygen sensor output is filtered a small amount. The catalyst index ratio value is less than threshold so that the catalyst is deemed "not degraded." The feed gas oxygen sensor is indicating rich and the CMS oxygen sensor is also indicating rich.

Between time t0 and time t1, the engine remains out of DFSO and the catalyst monitor is not activated. The CMS time constant remains unchanged and the catalyst index ratio remains unchanged. The feed gas oxygen sensor switches between rich and lean conditions while the CMS sensor also switches about stoichiometry, but at a lower switching rate.

At time t1, conditions for DFSO are met and the engine enters DFSO as indicated by the DFSO state changing from a low level to a high level. Fuel flow to the engine is stopped (not shown while the engine is in DFSO mode). The catalyst monitor state remains unchanged and the CMS sensor time constant is not changed. The catalyst index ratio value remains low and the upstream oxygen sensor output begins to transition to a low level to indicate a lean engine air-fuel ratio. The downstream oxygen sensor indicates a rich exhaust gas mixture.

Between time t1 and time t2, the engine remains in DFSO and the catalyst is not being monitored. The CMS time constant τ remains unchanged and the catalyst index ratio remains unchanged. The feed gas oxygen sensor indicates lean and remains indicating lean since air is pumped through the engine when the engine is in DFSO mode. The output of the CMS sensor is reduced at a slower rate than the output of the feed gas oxygen sensor, but the CMS sensor eventually indicate lean exhaust gases.

At time t2, the controller finishes estimating the CMS time constant and the CMS time constant τ value is updated. The value of τ is increase to indicate a longer time constant and a slower response time of the CMS sensor. The engine remains in DFSO and the catalyst monitor is not activated. The catalyst index ratio remains unchanged and the feed gas and CMS oxygen sensors indicate lean.

At time t3, the engine exits DFSO mode and the catalyst monitor is not activated. The engine begins combusting fuel (not shown) when it exits DFSO mode. The CMS time constant τ has not changed since time t2 and the catalyst index ratio remains unchanged. The feed gas oxygen sensor begins to indicate a rich engine air-fuel ratio and the CMS sensor continues to indicate lean since the catalyst is filled with oxygen that was pumped through the engine. Output of the feed gas oxygen sensor is filtered via a low-pass filter and the filter has a time constant that was established at time t3.

Between time t4 and time t5, the engine remains out of DFSO mode and the catalyst monitor is not activated. The CMS time constant τ has not changed since time t3 and the catalyst index ratio remains unchanged. The feed gas oxygen sensor output is filtered via a low pass filter that has a time constant that is equivalent to the time constant of the CMS sensor. Thus, output of the feed gas oxygen is more heavily filtered and it oscillates about stoichiometry at a slower rate than as shown between time t0 and time t1. The CMS sensor output increases to indicate rich and then it slowly modulates.

At time t5, the engine remains not in DFSO, but the catalyst monitor is now activated. The controller begins to sample the feed gas oxygen sensor and the CMS sensor (not shown). The controller also stores values of the filtered modified feed gas oxygen sensor output voltage to controller memory. Additionally, the controller stores values of the CMS oxygen sensor output voltage to controller memory. The catalyst index ratio remains unchanged and the CMS time constant τ remains unchanged. The engine air-fuel ratio is oscillated about a stoichiometric air-fuel ratio while the catalyst monitor is activated.

At time t6, the engine remains out of DFSO mode and the catalyst monitor is deactivated. The CMS time constant τ remains unchanged and the catalyst index ratio value is adjusted to a new value based on the ratio of a line length of the CMS oxygen sensor output voltage to a line length of the feed gas oxygen sensor output voltage. The catalyst index value is less than threshold 550 so it is determined that the catalyst is operating within a desired range (not shown). The filtered feed gas oxygen sensor output continues to modulate as does the CMS oxygen sensor output.

In this way, a time constant of a CMS oxygen sensor may be determined and the time constant may be applied to a low-pass filter that receives output of a feed gas oxygen sensor as input. The filtered feed gas oxygen sensor output and the CMS oxygen sensor output are then the basis for determining a catalyst index ratio that provides a measure or reference to determine catalyst performance.

Referring now to FIG. 6, a plot of two different ways that a time constant of a CMS sensor may be estimated is shown. Plot 600 includes a vertical axis that represents output voltage of a CMS oxygen (e.g., downstream oxygen sensor) sensor. The horizontal axis represents time and time increases from the left side of the plot to the right side of the plot. Curve 601 represents CMS oxygen sensor output voltage. Horizontal line 654 represents the CMS oxygen sensor rich indicating level at a time just before the engine enters DFSO mode. Horizontal line 656 represents a final stabilized CMS oxygen sensor lean indicating level after the engine enters DFSO mode and the CMS oxygen sensor responds to lean exhaust gases. Vertical line 650 represents a time when the engine enters DFSO mode and fuel injection to the engine is ceased. Vertical line 652 represents a time at which output of the CMS oxygen sensor reaches roughly 63% of its final value after the exhaust gas changes from rich to lean. The amount of time it takes for the CMS oxygen sensor to reach 63% of its final value after exhaust gas changes from rich to lean is indicated by arrow 604 (e.g., the CMS oxygen sensor time constant τ value).

The value of τ may be determined via monitoring CMS oxygen sensor output voltage between a time when the engine enters DFSO (e.g., the time at line 650) and a time that the CMS oxygen sensor reaches its final stabilized lean value (e.g., the time at line 660). Then a CMS voltage that is 63% less than the voltage difference between the voltage at line 654 and the voltage at line 656 may be subtracted from the voltage of line 654 to determine the 63% voltage value. The time where line 601 reaches the 63% voltage value is the time where CMS oxygen sensor output voltage reaches the 63% voltage value (e.g., represented by line 652). The amount of time between the time the CMS oxygen sensor output voltage reaches the 63% voltage value and the time the exhaust gas switched from rich to lean is the time constant τ, which is indicated by line 604.

Alternatively, a slope of the CMS oxygen sensor output voltage approximated by line 601 may be determined between a time when the exhaust gas switches from rich to lean (e.g., the time indicated by line 650) and a time where output of the CMS oxygen sensor stabilizes at a final lean voltage value (e.g., the time indicated by line 660) to estimate the CMS oxygen sensor time constant as described at 410 of FIG. 4. The slope of line 601 may then be converted into a low-pass filter time constant via a table or function stored in controller memory.

Referring now to FIG. 7, a first engine 10 and exhaust system 11 are shown. In this example, engine 10 is followed by feed gas or upstream oxygen sensor 126. Exhaust gas flows from engine 10 to oxygen sensor 126 and then to catalyst 178. Converted exhaust gases leave catalyst 178 and are sensed via CMS or downstream oxygen sensor 158 before being released to atmosphere. In this example, engine 10 includes only a single bank of cylinders (not shown).

Referring now to FIG. 8, a second engine 10 and exhaust system 11 are shown. In this example, engine 10 is followed by feed gas or upstream oxygen sensors 126 and 127. Exhaust gas flows from engine 10 to oxygen sensors 126 and 127 before flowing to catalyst 178 and catalyst 179. Converted exhaust gases leave catalysts 178 and are sensed via CMS or downstream oxygen sensor 158 before being released to atmosphere. Converted exhaust gases leave catalysts 179 and are sensed via CMS or downstream oxygen sensor 159 before being released to atmosphere. In this example, engine 10 includes two banks of cylinders (not shown). The first bank of cylinders directs exhaust gas to catalyst 178 via pipe 801 and the second bank of cylinders directs exhaust gas to catalyst 179 via pipe 802.

Note that the example control and estimation routines included herein can be used with various engine and/or vehicle system configurations. The control methods and routines disclosed herein may be stored as executable instructions in non-transitory memory and may be carried out by the control system including the controller in combination with the various sensors, actuators, and other engine hardware. The specific routines described herein may represent one or more of any number of processing strategies such as event-driven, interrupt-driven, multi-tasking, multi-threading, and the like. As such, various actions, operations, and/or functions illustrated may be performed in the sequence illustrated, in parallel, or in some cases omitted. Likewise, the order of processing is not necessarily required to achieve the features and advantages of the example examples described herein, but is provided for ease of illustration and description. One or more of the illustrated actions, operations and/or functions may be repeatedly performed depending on the particular strategy being used. Further, the described actions, operations and/or functions may graphically represent code to be programmed into non-transitory memory of the computer readable storage medium in the engine control system, where the described actions are carried out by executing the instructions in a system including the various engine hardware components in combination with the electronic controller.

It will be appreciated that the configurations and routines disclosed herein are exemplary in nature, and that these specific examples are not to be considered in a limiting sense, because numerous variations are possible. For example, the above technology can be applied to V-6, I-4, I-6, V-12, opposed 4, and other engine types. The subject matter of the present disclosure includes all novel and non-obvious combinations and sub-combinations of the various systems and configurations, and other features, functions, and/or properties disclosed herein.

The following claims particularly point out certain combinations and sub-combinations regarded as novel and non-obvious. These claims may refer to "an" element or "a first" element or the equivalent thereof. Such claims should be understood to include incorporation of one or more such elements, neither requiring nor excluding two or more such elements. Other combinations and sub-combinations of the disclosed features, functions, elements, and/or properties may be claimed through amendment of the present claims or through presentation of new claims in this or a related application. Such claims, whether broader, narrower, equal, or different in scope to the original claims, also are regarded as included within the subject matter of the present disclosure.

The invention claimed is:

1. An engine operating method, comprising:

filtering output of an oxygen sensor located upstream of a catalyst in an exhaust system of an engine via a controller according to a response of an oxygen sensor located downstream of the catalyst; and adjusting an ignition system via the controller responsive to the filtered output of the oxygen sensor.

2. The method of claim 1, where the actuator is a fuel injector and where the fuel injector is adjusted to reduce an amplitude of an engine air-fuel ratio.

3. The method of claim 1, where an actuator is a fuel injector and where the fuel injector is adjusted to increase a frequency of an engine air-fuel ratio.

4. The method of claim 1, where filtering includes digitally filtering output of the oxygen sensor located upstream of the catalyst.

5. The method of claim 1, where filtering includes applying a first order low-pass filter having a time constant or a smoothing factor that is based on output of the oxygen sensor located downstream of the catalyst.

6. The method of claim 1, where filtering includes adding a weighted past output of the oxygen sensor located upstream of the catalyst to a weighted present output of the oxygen sensor located upstream of the catalyst.

7. The method of claim 1, where the oxygen sensor located upstream of the catalyst is a wide band linear oxygen sensor.

8. An engine operating method, comprising:

entering an engine into a fuel cut-off mode via a controller;

estimating a time constant of an oxygen sensor located downstream of a catalyst in an exhaust system of the engine from output of the oxygen sensor generated while the engine is in the fuel cut-off mode via the controller;

filtering output of an oxygen sensor located upstream of the catalyst according to a response of the oxygen sensor located downstream of the catalyst via the controller; and adjusting an actuator via the controller responsive to the filtered output of the oxygen sensor located upstream of the catalyst.

9. The method of claim 8, where the time constant is estimated according to a change in an output of the oxygen sensor located downstream of the catalyst.

10. The method of claim 8, further comprising generating a length of a line from an output of the oxygen sensor located downstream of the catalyst.

11. The method of claim 10, further comprising generating a length of a line from the output of the oxygen sensor located upstream of the catalyst.

12. The method of claim 11, further comprising determining a catalyst index ratio via the length of the line from the output of the oxygen sensor located downstream of the catalyst and the length of the line from the output of the oxygen sensor located upstream of the catalyst.

13. The method of claim 12, where the catalyst index ratio is based on the filtered output of the oxygen sensor located upstream of the catalyst.

14. A system for operating an engine, comprising:

an internal combustion engine including an actuator;

an exhaust system coupled to the internal combustion engine, the exhaust system including a first oxygen sensor, a second oxygen sensor, and a catalyst; and a controller including executable instructions stored in non-transitory memory to adjust a parameter of a digital filter, the digital filter applied to output of the first oxygen sensor, a value of the parameter based on a time constant of the second oxygen sensor, and additional instructions to adjust an air-fuel ratio of the engine responsive to output of the digital filter.

15. The system of claim 14, where the first oxygen sensor is located upstream of the catalyst.

16. The system of claim 15, where the second oxygen sensor is located downstream of the catalyst.

17. The system of claim 14, where the digital filter is a low-pass digital filter.

18. The system of claim 14, further comprising additional instructions to determine the time constant from a voltage output via the second oxygen sensor.

19. The system of claim 18, further comprising additional instructions to determine a catalyst index ratio from output of the digital filter.

* * * * *